United States Patent [19]

Shinbach

[11] Patent Number: 4,598,826

[45] Date of Patent: Jul. 8, 1986

[54] HEAT-SEALABLE, LAMINATED PACKAGE

[75] Inventor: Madeline P. Shinbach, St. Paul, Minn.

[73] Assignee: Minnesota Mining and Manufacturing Company, St. Paul, Minn.

[21] Appl. No.: 670,147

[22] Filed: Nov. 9, 1984

[51] Int. Cl.[4] ..... B65D 33/30

[52] U.S. Cl. ..... 206/620; 229/3.5 MF

[58] Field of Search ..... 206/620, 627, 628, 631, 206/632, 633, 604, 784, 634; 229/3.5 MF, 43; 383/113, 116, 119

[56] References Cited

U.S. PATENT DOCUMENTS

| | | | |
|---|---|---|---|
| 3,127,087 | 3/1964 | Spees | 229/51 |
| 3,485,349 | 12/1969 | Chaney, Jr. | 206/620 X |
| 3,535,409 | 10/1970 | Rohde | 206/620 X |
| 3,554,436 | 1/1971 | Palmer | 206/620 X |
| 3,608,566 | 9/1971 | Storandt | 206/620 X |
| 3,648,704 | 3/1972 | Jackson | 206/620 X |
| 3,770,122 | 11/1973 | Thiele | 229/3.5 MF X |
| 3,873,735 | 3/1975 | Chalin et al. | 229/3.5 MF X |
| 4,139,643 | 2/1979 | Hix et al. | 206/631 |
| 4,246,288 | 1/1981 | Sanborn, Jr. | 229/43 X |
| 4,279,344 | 7/1981 | Holloway, Jr. | 426/122 |
| 4,433,680 | 2/1984 | Yoon | 128/90 |

FOREIGN PATENT DOCUMENTS

| | | |
|---|---|---|
| 0012275 | 6/1980 | European Pat. Off. . |
| 1171879 | 1/1959 | France . |
| 2296572 | 7/1976 | France . |

*Primary Examiner*—Steven M. Pollard

*Attorney, Agent, or Firm*—Donald M. Sell; James A. Smith; Robert W. Hoke, II

[57] ABSTRACT

A heat-sealable, laminated package for hermetically sealing an object in a pouch of the package. The package has means for facilitating manual tearing the pouch along a predetermined path. The facilitating means includes two closely-spaced stiffened portions on opposite sides of the predetermined path and cut means at one end of the predetermined path for facilitating tearing the pouch along the predetermined path and between the two closely-spaced stiffened portions.

3 Claims, 5 Drawing Figures

HEAT-SEALABLE, LAMINATED PACKAGE

BACKGROUND OF INVENTION

The invention relates to heat-sealable, laminated packages for hermetically sealing an object therein and, in particular, to such a package having means for facilitating manual tearing of the package.

Packages constructed from flexible, laminated materials are well known. Many types of objects are hermetically sealed in laminated packages to preserve their freshness. Such a package is described in U.S. Pat. No. 4,139,643. The package comprises a three-ply laminated pouch. At column 2, starting at line 39, the laminate is described as preferably consisting of an outer ply of polypropylene or polyester, a central ply of aluminum foil and an inner ply of any suitable, heat-sealable thermal plastic material. Starting at column 3, line 20, the package is described as having transverse parallel lines of weakness formed across one of the heat seals.

Another laminated package is described in U.S. Pat. No. 4,279,344. The package is described as including three layers. As with the package of the earlier patent, the package is described starting at column 2, line 29, as having an outer layer formed of a plastics resin material, a central structural barrier layer formed of a metallic foil, such as aluminum foil, and an inner layer formed of a suitable heat-sealable material. Suitable heat-sealable layers are described starting at column 2, line 58 to include a polypropylene or a polyethylene-polypropylene copolymer blended with an ionomer resin. The package is described as openable by peeling apart two of the lamina along the heat seal.

SUMMARY OF THE INvENTION

Lines of weakness and peelable, heat-sealable laminates are believed to represent areas which can fail and allow the passage of air and/or water vapor. Such passage of air and/or water vapor into the package can prove ruinous to some objects sealed therein. One such type of objects is polyurethane orthopedic casting bandages which are used to form orthopedic casts. Such bandages are moisture curing. Even minute amounts of moisture can severely reduce the shelf life of such bandages, as noted in U.S. Pat. No. 4,433,680.

According to the invention, there is provided a package comprising a laminate sheet material and means for facilitating manual tearing of the sheet material along a predetermined path. The laminate sheet material includes a metal foil highly impervious to air and water vapor, a puncture resistant outer material laminated to one major surface of the metal foil and a heat-sealable plastic film laminated to the major surface of the metal foil opposite the outer material. The heat-sealable plastic film includes portions sealed together to form a pouch having interior and exterior walls and unsealed portions comprising the interior wall of the pouch. The sealed portions provide stiffened portions highly impervious to air and water vapor. The means for facilitating manual tearing of the sheet material along the predetermined path include two closely-spaced stiffened portions and cut means for facilitating tearing the pouch along the predetermined path between the two closely-spaced stiffened portions.

BRIEF DESCRIPTION OF THE DRAWING

Other advantages of the invention will become apparent from the following drawing where like numerals refer to like parts.

DESCRIPTION

Figure 1:
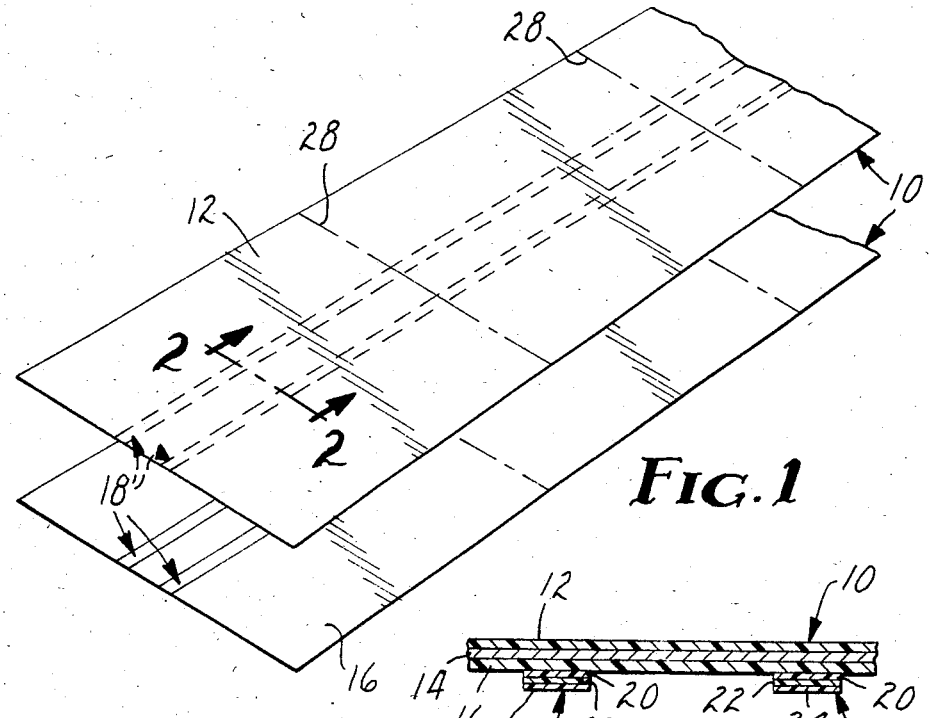
FIG. 1 is a fragmented, perspective view of suitable laminate sheet material of the present invention.
Figure 2:
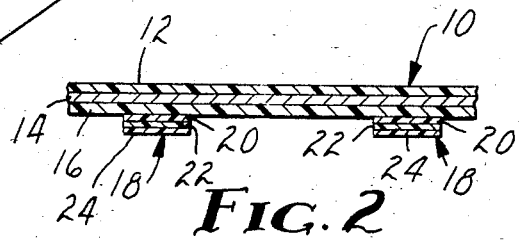
FIG. 2 is a greatly enlarged cross-sectional view of the laminate sheet material of FIG. 1 taken approximately along the line 2—2 of FIG. 1.

Referring now to FIGS. 1 and 2 of the drawing, there is shown, in perspective view in FIG. 1 and in cross-sectional view in FIG. 2, a laminate sheet material 10 used to form the package of the present invention. As seen in FIG. 2, the laminate sheet material 10 is comprised of an outer layer 12, and intermediate layer 14 and an inner layer 16. Laminated to the inner layer 16 is a length of tear resistant strip material 18. The strip material 18 may be comprised of a single layer or, preferably, multiple layers as seen in FIG. 2. Referring to FIG. 2, the strip material 18 is shown as comprising an inner layer 20, an intermediate layer 22 and an outer layer 24.

The sheet material 10 and the strip material 18 are comprised of conventional materials that are pressure and/or adhesive laminated together in conventional fashion as will next be described. Intermediate layer 14 of sheet material 10 is comprised of a metal foil that is highly impervious to air and water vapor. Preferably, the intermediate layer 14 is comprised of an aluminum foil having a thickness in the range of about 0.0051 millimeters to 0.0127 millimeters and preferably about 0.0089 millimeters. Although it is preferred that such aluminum foil be entirely free of even minute holes, it is known that such aluminum foil remains highly impervious to air and water vapor transmission even when having a few widely scattered, minute openings there through. By highly impervious, then, it is meant that as little as possible air and water vapor can pass through minute openings occurring in currently available metal foils. The outer layer 12 of the laminate sheet material 10 is comprised of a protective, puncture-resistant paper or plastic resin material. Preferably, the outer layer 12 is comprised of a polyester or a polypropylene that is laminated to the aluminum foil of the intermediate layer 14 by conventional extrusion or adhesive bonding. Preferably, adhesive extrusion laminating is employed. The inner layer 16 of the sheet material 10 is comprised of a heat-sealable material which can be laminated onto the aluminum foil of the intermediate layer 14 by adhesives, extrusion or the like. Preferably, the heat-sealable material is a plastics resin film such as a polypropylene, a polyethylene or a polyethylene-polypropylene copolymer that is extruded and/or calendered directly onto the aluminum foil. Most preferably, the heat-sealable material is "Surlyn" brand ionomer resin available from DuPont De Nemours & Co. (Inc.), Wilmington, Del.

which is extruded and/or calendered directly onto the aluminum foil.

As earlier noted, the strip material 18 can be of a single or multiple layer construction. A suitable single layer can comprise a heat-sealable material which can be laminated to the inner layer 16 of the sheet material 10. Suitable heat-sealable materials include Surlyn resin or ethylene vinyl acetate having a thickness in the range of about 0.0381 millimeters to 0.1143 millimeters and preferably about 0.0782 millimeters. Preferably, the strip material 18 is comprised of three layers, as already noted. In the most preferred embodiment, the strip material 18 comprises the inner layer 20 of the heat-sealable material used for inner layer 16 of sheet material 10, the intermediate layer 22 of a relatively tougher material and the outer layer 24 comprising the same material as the inner layer 20. The intermediate layer 22 is preferably a polyester having a thickness in the range of about 0.0127 to 0.0381 millimeters and more preferably about 0.0254 millimeters. The inner layer 20 and the outer layer 24 preferably have a thickness in the range of 0.0127 millimeters to 0.0381 millimeters and more preferably about 0.0254 millimeters.

Figure 3:
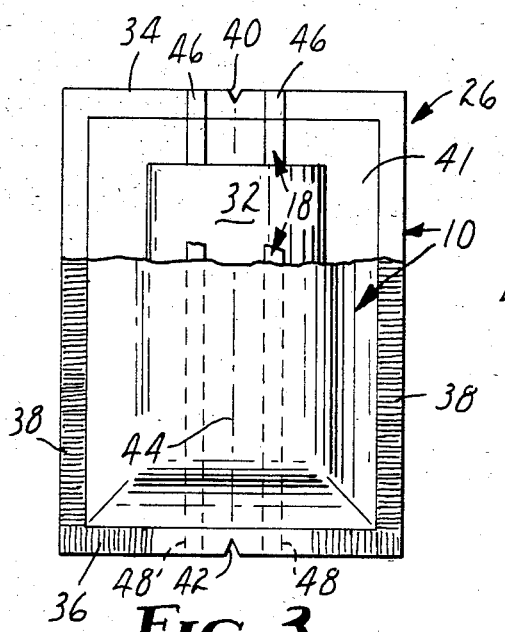
FIG. 3 is a plan view of one embodiment of the package of the present invention with portions broken away to show an object therein.

FIG. 3 shows in plan view a first embodiment of a package 26 of the present invention formed from the laminate sheet material 10 and from the tear resistant strip material 18. The package 26 can be generally formed from a single piece of sheet material 10 or two pieces of sheet material 10. The package 26 is generally formed by peripherally heat sealing the sheet material 10 to itself or to a second piece of sheet material 10. When formed from two pieces of sheet material 10, the formation can be most easily understood by reference to FIG. 1. The two pieces of sheet material 10 and the strip material 18 are cut generally transversely at a line 28 and positioned in a face-to-face relation to juxtapose the lengths of strip material 18. As a result, the strip material 18 is positioned inside what becomes the package 26.

Referring again to FIG. 3, there is shown the package 26 partially broken away to expose an object 32 otherwise hermetically sealed therein. As already described, the package 26 includes one or two pieces of sheet material 10 peripherally heat sealed together at two end heat seals 34 and 36 and two side heat seals 38 to form a pouch 39 having interior walls 41. The seals 34, 36 and 38 provide stiffened portions of the pouch 39 that are highly impervious to air and water vapor. By highly impervious, it is meant that as little as possible, and preferably no, air and water vapor passes through these stiffened portions of the pouch 39. Within the end heat seals 34 and 36 are cut means 40 and 42, respectively, for facilitating tearing the package 26 along a predetermined tear path 44 between two closely-spaced lengths of tear resistant strip material 18.

Each of the lengths of the tear resistant strip material 18 is laminated across one of the interior walls of the pouch 39 to provide a stiffened portion of the pouch 39. Each of the strip materials 18 has a first end portion 46 sealed to and extending between the heat seal 34 to highly preclude and preferably totally prevent the passage of air and water vapor between the heat seal 34 adjacent the first end portion 46 of the strip 18. Each of the strip materials 18 similarly has a second end portion 48 sealed to and extending between the heat seal 36. When a tear is manually initiated in the area of the cut means 40 or the cut means 42, the tear is propagated along the predetermined tear path 44 between the stiffened portions provided by the four lengths of tear resistant strip material 18 to fully expose the object 32 and, thereby, to facilitate the removal of the object 32 from the package 26. The strip materials 18 provide tear-resistant barriers that can guide the tear along the predetermined tear path 44. Although the package 26 of FIG. 3 has been provided with four lengths of strip material 18, it has been found that the two lengths of strip material 18 laminated across either of the interior walls 41 of the pouch 39 will suffice. Similarly, the lengths of the strip material 18 can be conventionally pressure or adhesive laminated across either or both of the exterior, rather than the interior, walls of the pouch 39.

Figure 4:
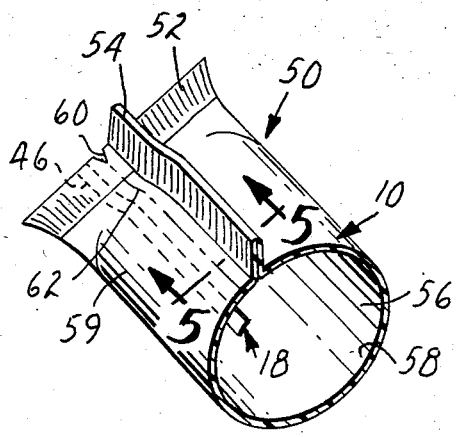
FIG. 4 is a perspective view of an alternative and preferred embodiment of the package of the present invention.
Figure 5:
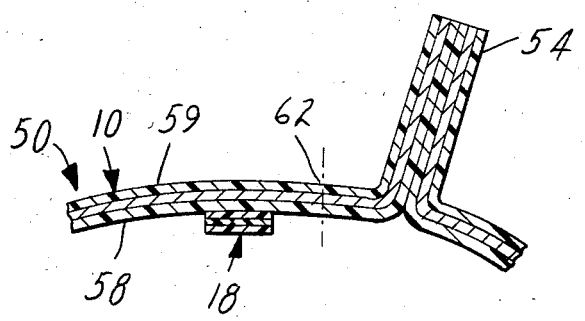
FIG. 5 is an enlarged, fragmented, cross-sectional view of the embodiment of FIG. 4 taken approximately along the line 5—5 of FIG. 4.

FIGS. 4 and 5 of the drawings show an alternative and preferred embodiment of the package of the present invention. Referring first to FIG. 4, a package 50 is shown in perspective view to be generally of a conventional fin-seal construction. The package 50 is conventionally formed around the object 32, shown in FIG. 3, from a single sheet of laminate sheet material 10 to have a fin seal 54 and a first end heat seal 52 to form a pouch 56 containing the object 32. The fin seal 54 provides a stiffened portion of the pouch 56.

The pouch 56 has an interior wall 58 and an exterior wall 59. Laminated to the interior wall 58 is one length of tear resistant strip material 18 as earlier described. The strip material 18 can alternatively be laminated to the exterior wall 59. The strip material 18 provides a second stiffened portion of the pouch 56 that is closely spaced from the stiffened portion provided by the fin seal 54 as perhaps best seen in FIG. 5. Within the heat seal 52 is a cut means 60 between the two closely-spaced stiffened portions provided by the fin seal 54 and the strip material 18 for facilitating tearing the package 50 along a predetermined path 62 between the two closely-spaced stiffened portions. As with the strip material 18 of the embodiment of FIG. 3, the strip material 18 of the package 50 of FIG. 4 has the first end portion 46 sealed to and extending between the heat seal 52 to highly preclude and preferably totally prevent the passage of air and water vapor between the heat seal 52 adjacent the first end portion 46 of the strip 18. The package 50 is completed by heat sealing the pouch 56 at the end opposite the heat seal 52. In so doing, a second cut means similar to the cut means 60 and a second end portion similar to the first end portion 46 can be provided.

The following non-limiting examples are provided:

EXAMPLE 1

The preferred embodiment 50 of the package of the present invention, shown in FIGS. 4 and 5, was formed. The strip material 18 was of the multiple layer construction. The intermediate layer 22 was a polyester film having good tear resistance. The inner layer 20 and the outer layer 24 was Surlyn resin. Each of layers 20, 22 and 24 of the strip material 18 was approximately 0.0254 millimeters thick. The sheet material 10 was a low density polypropylene, aluminum foil and Surlyn resin laminate. The aluminum foil was approximately 0.0089 millimeters thick. The polypropylene and the Surlyn resin were each approximately 0.0381 millimeters thick. The polypropylene was extrusion laminated to the aluminum foil by a very thin layer of polyethylene.

The strip material 18 was sealed to the interior wall 58 of the package 50 with an intermittent sealer using a temperature of approximately 174±25 degrees Celsius.

The pressure applied by the sealer was approximately 2.8±0.7 kilograms per square centimeter. The dwell time of the sealer was approximately 1.0±0.5 seconds.

EXAMPLE 2

Example 1 was repeated except that a continuous sealer, rather than the intermittent sealer, was used to seal the strip material 18 to the interior wall 58.

EXAMPLE 3

Example 1 was repeated except that ethylene vinyl acetate was substituted for the Surlyn resin in layers 20 and 24 of the strip material 18. The strip material 18 was sealed to the interior wall 58 of the package 50 with an intermittent sealer using a temperature of approximately 149±28 degrees Celsius. The pressure applied by the sealer was approximately 2.8±0.7 kilograms per square centimeter. The dwell time was approximately 1.0±0.5 seconds.

EXAMPLE 4

Example 3 was repeated except that a continuous sealer, rather than the intermittent sealer, was used to seal the strip material 18 to the interior wall 58.

EXAMPLE 5

Example 1 was repeated except that a single-layer strip material 18 was laminated to the exterior wall 59 of the package 50.

The strip material 18 was a polyester film having a thickness of approximately 0.041 millimeters. The polyester film was coated on one side with a rubber-based adhesive and pressure laminated to the exterior wall 59 of the package 50.

EXAMPLE 6

Example 1 was repeated except that a two-layer strip material 18 was laminated to the exterior wall 59 of the package 50. The strip material 18 was a polyester film having a thickness of approximately 0.041 millimeters. The polyester film was coated on one side with Surlyn resin and heat sealed to the exterior wall 59.

EXAMPLE 7

Example 6 was repeated except that a continuous sealer, rather than the intermittent sealer, was used to seal the strip material 18 to the exterior wall 59.

EXAMPLE 8

The embodiment 26 of the package of the present invention, shown in FIG. 3, was formed. The strip materials 18 were each of multiple layer construction described in Example 1. The sheet material 10 was as described in Example 1. The strip materials 18 were sealed to the interior walls 41 of the package 26 as described in Example 1 for the package 50.

EXAMPLE 9

The embodiment 26 of the package of the present invention, shown in FIG. 3, was formed. The strip materials 18 were each of the multiple layer construction described in Example 3. The sheet material 10 was as described in Example 3. The strip materials 18 were sealed to the interior walls 41 of the package 26 as described in Example 3 for the package 50.

What is claimed is:

1. A package comprising:

a. a laminate sheet material including:

(1) a metal foil highly impervious to air and water vapor;

(2) a puncture resistant outer material laminated to one major surface of said metal foil; and (3) a heat-sealable plastic inner film laminated to the major surface of said metal foil opposite said outer material, said heat-sealable plastic inner film including (a) sealed portions forming a pouch of said laminate sheet material, said pouch having at least one interior wall and at least one exterior wall, and said sealed portions providing stiffened portions highly impervious to air and water vapor, and (b) unsealed portions comprising said interior wall of said pouch; and b. means for facilitating tearing of said sheet material along a predetermined path across said pouch, said means comprising:

(1) at least one length of heat-sealable, polymeric, tear resistant strip material laminated across said interior wall of said pouch to provide another stiffened portion of said pouch and having a first end portion sealed to and extending between said sealed portions of said pouch to highly preclude the passage of air and water vapor between said sealed portions and said first end portion of said length of strip material;

(2) said pouch having two closely-spaced stiffened portions on opposite sides of said predetermined path at least one of which includes the length of tear resistant strip material; and (3) cut means at one end of said predetermined path for facilitating tearing said pouch along said predetermined path between said two closely-spaced stiffened portions.

2. The package according to claim 1 wherein said length of tear resistant strip material comprises:

a. a polyester film;

b. a first heat-sealable plastic film laminated to one major surface of said polyester film; and c. a second heat-sealable plastic film having one major surface laminated to the major surface of the polyester film opposite said first heat-sealable plastic film and having the other major surface laminated to said pouch.

3. The package according to claim 2 wherein said length of tear resistant strip material further comprises a second end portion sealed to and extending between said sealed portions of said pouch to highly preclude the passage of air and water vapor between said sealed portions and said second end portion of said length of strip material.

* * * * *